US011548684B2

(12) United States Patent
Su et al.

(10) Patent No.: US 11,548,684 B2
(45) Date of Patent: Jan. 10, 2023

(54) LOCKSET AND PALLET LOADING BIN HAVING SAME

(71) Applicants: DALIAN CIMC SPECIAL LOGISTICS EQUIPMENTS CO., LTD., Liaoning (CN); CHINA INTERNATIONAL MARINE CONTAINERS (GROUP) LTD., Guangdong (CN); CIMC CONTAINERS HOLDING COMPANY LTD., Guangdong (CN); DALIAN CIMC LOGISTICS EQUIPMENT CO., LTD., Liaoning (CN)

(72) Inventors: Jijun Su, Dalian (CN); Chunliang Liu, Dalian (CN); Jiansheng Ni, Dalian (CN); Bo Li, Dalian (CN)

(73) Assignees: CHINA INTERNATIONAL MARINE CONTAINERS (GROUP) LTD., Guangdong (CN); CIMC CONTAINERS HOLDING COMPANY LTD., Guangdong (CN); DALIAN CIMC LOGISTICS EQUIPMENT CO., LTD., Liaoning (CN)

( * ) Notice: Subject to any disclaimer, the term of this patent is extended or adjusted under 35 U.S.C. 154(b) by 679 days.

(21) Appl. No.: 16/493,436

(22) PCT Filed: Mar. 19, 2018

(86) PCT No.: PCT/CN2018/079471

§ 371 (c)(1),
(2) Date: Sep. 12, 2019

(87) PCT Pub. No.: WO2018/177150

PCT Pub. Date: Oct. 4, 2018

(65) Prior Publication Data

US 2020/0010239 A1 Jan. 9, 2020

(30) Foreign Application Priority Data

Mar. 28, 2017 (CN) ..... 201710193903.X

(51) Int. Cl.
*B65D 19/38* (2006.01)
*B65D 19/02* (2006.01)
(Continued)

(52) U.S. Cl.
CPC ..... *B65D 19/38* (2013.01); *B65D 19/02* (2013.01); *E05B 65/00* (2013.01); *E05C 3/004* (2013.01);
(Continued)

(58) Field of Classification Search
CPC ..... B65D 19/02; B65D 19/38; B65D 2519/00572; B65D 2519/00611; B65D 2519/00661
See application file for complete search history.

(56) References Cited

U.S. PATENT DOCUMENTS 3,622,189 A * 11/1971 Rosehitz ..... E05B 65/0811 292/108
3,642,314 A * 2/1972 Smith ..... E05B 65/0811 292/134
(Continued)

FOREIGN PATENT DOCUMENTS

CN 103204304 A 7/2013
CN 105235979 A 1/2016
(Continued)

OTHER PUBLICATIONS

International Search Report (in English and Chinese) and Written Opinion (in Chinese) issued in PCT/CN2018/079471, dated Jun. 25, 2018; ISA/CN.
(Continued)

*Primary Examiner* — Matthew W Ing
(74) *Attorney, Agent, or Firm* — Harness, Dickey & Pierce, P.L.C.; Stephen T. Olson

(57) ABSTRACT

Provided are a lockset and a pallet loading bin having the same. A lock hole is arranged at the pallet loading bin. The lockset comprises a lock bar and a handle. A first end of the lock bar is provided with a hook member for fitting the lock hole to realize locking. A connection portion is provided at the lock bar. The lock bar is rotatably connected, through the
(Continued)

connection portion, to a bin body of the pallet loading bin. Rotation of the lock bar around the connection portion in a plane parallel to an outer surface of the bin body causes the hook member to extend into or retract from the lock hole, thereby realizing locking or unlocking of the lockset. The handle comprises a connection end. The handle is rotatably connected, through the connection end, to a second end of the lock bar opposite to the first end of the lock bar. Rotation of the handle around the connection end causes the handle to be positioned close to or away from the outer surface of the bin body. The lockset has a simple structure and low costs, can be processed and manufactured easily, can be operated flexibly with less effort, and adapts to the small thicknesses of an end wall and a side wall of a pallet loading bin.

17 Claims, 9 Drawing Sheets

(51) Int. Cl.

| | |
|---|---|
| ***E05B 65/00*** | (2006.01) |
| ***E05C 3/00*** | (2006.01) |
| ***E05C 3/04*** | (2006.01) |
| ***E05C 3/08*** | (2006.01) |

(52) U.S. Cl.
CPC ..... *E05C 3/047* (2013.01); *E05C 3/08* (2013.01); *B65D 2519/00572* (2013.01); *B65D 2519/00611* (2013.01); *B65D 2519/00661* (2013.01)

(56) References Cited

U.S. PATENT DOCUMENTS

| | | | | |
|---|---|---|---|---|
| 8,960,733 | B1 * | 2/2015 | Smith | E05C 7/02 292/226 |
| 9,702,172 | B2 | 7/2017 | Su et al. | |
| 10,092,089 | B1 * | 10/2018 | Yuan | A47B 3/002 |
| 2003/0227180 | A1 * | 12/2003 | Tweedt | E05C 5/00 292/336.3 |
| 2004/0140676 | A1 * | 7/2004 | Eklund | E06B 3/485 292/97 |
| 2014/0367289 | A1 * | 12/2014 | Su | E05B 63/12 206/386 |
| 2016/0319577 | A1 * | 11/2016 | Liang | E05C 3/14 |
| 2019/0375545 | A1 * | 12/2019 | Su | E05C 3/004 |

FOREIGN PATENT DOCUMENTS

| | | | |
|---|---|---|---|
| CN | 206624127 | U | 11/2017 |
| DE | 1655567 | A | 4/1971 |
| JP | 2003104374 | A | 4/2003 |
| JP | 3176013 | U | 6/2012 |
| JP | 3188648 | U | 1/2014 |

OTHER PUBLICATIONS

Notice of Reasons for Refusal received for the Japanese Patent Application No. 2019-569532, dated Nov. 10, 2020, 4 pages (2 pages of English Translation and 2 pages of Original Copy).

Notice of Reason for Rejection received for the Korean Patent Application No. 10-2019-7025319, dated Dec. 1, 2020,13 pages (7 pages of English Translation and 6 pages of Original Copy).

Extended European Search Report received for the European Patent Application No. 118777250.4, dated Jul. 21, 2020, 8 pages.

Written Opinion received for the Singapore Patent Application No. 11201906892P, dated Aug. 25, 2020, 6 pages.

Notice of Decision to Grant received for the Japanese Application No. JP2019-569532, dated Mar. 9, 2021, 5 pages (2 pages of English translation and 3 pages of Official document).

Notice of Decision to Grant received for the Korean Application No. KR10-2019-7025319, dated Apr. 1, 2021, 4 pages (2 pages of English translation and 2 pages of Official document).

Notice of Eligibility for Grant with an examination report dated Jan. 24, 2022 for corresponding Singapore application No. 11201906892P.

* cited by examiner

LOCKSET AND PALLET LOADING BIN HAVING SAME

CROSS-REFERENCE TO RELATED APPLICATIONS

This application is a 371 U.S. National Phase of International Application No. PCT/CN2018/079471, filed Mar. 19, 2018, which claims priority to Chinese Patent Application No. 201710193903.X, filed Mar. 28, 2017. The entire disclosures of the above applications are incorporated herein by reference.

TECHNICAL FIELD

The present invention generally relates to the technical field of container transportation, and more specifically to a lockset and a box pallet having the same.

BACKGROUND

In order to facilitate the loading and unloading of cargos and the stacking transport of empty box pallet, the end and side walls of the box pallet are usually set in a detachable or foldable form. The end wall of the box pallet needs to be provided with a lockset connected with an adjacent side wall stand column to lock the adjacent end wall and side wall together so as to keep them relatively fixed when loading cargoes.

As shown in FIG. 1, an existing box pallet lockset is provided. When the lockset needs to be unlocked, a stopper 113' is firstly moved upward to be completely separated from a lock hook 111', and an operator rotates the handle 112' downward so that the lock hook 111' is separated from a side wall stand column 21', and at this time, there is no link constraint of the lockset between the end wall and the side wall, and the end wall and the side wall can be disassembled or folded. At present, the use of the lockset has limitation because the handle 112' has to be held by a single hand during the process of rotation, which then has a requirement for the operating space (a vertical distance between the outer surface of the end wall plate 10' and the inner side of the handle 112'). However, since the lockset should be located within the vertical distance (i.e., the thickness of the end wall) between the outer surface of the end wall panel 10' and the outer surface of the end wall stand column 11', that is, the lockset cannot extend beyond the outer surface of the end wall stand column 11' and the distance from the inner side of the handle 112' to the outer surface of the end wall plate 10' must ensure that the fingers could normally stick into so as to hold the handle 112', thus, when the thickness of the end wall is small, the vertical distance between the outer surface of the end wall plate 10' and the inner side of the handle 112' is too small for fingers to normally stick into, this lockset is no longer suitable for such a box pallet. In addition, a separately arranged stopper 113' needs to be provided for such a lockset, thereby leading to a complicated structure and requiring two-hand operation during operation, i.e. moves the stopper 113' with one hand, and rotates the handle 112' with the other hand, which is inconvenient to operate.

In order to increase the volume of the box pallet and reduce the height of the box pallet after being folded, thereby increasing the loading capacity of the box pallet and the transportation amount of empty boxes, and reducing the logistics transportation cost, the thickness of the end and side walls of the existing box pallet are currently designed to be as small as possible, which is not applicable to the lockset of the prior art.

Therefore, a lockset and a box pallet having the same need to be provided to at least partially solve the above problem.

SUMMARY

In order to at least partially solve the above problem, the present invention provides a lockset for a box pallet, on which a lock hole corresponding to the lockset is provided, the lockset comprises:

a lock bar, a first end of which being provided with a hook head matched with the lock hole to realize locking, the lock bar being provided with a connection portion, wherein the lock bar is rotatably connected to a body of the box pallet through the connection portion, and as the lock bar rotates around the connection portion in a plane parallel to an outer surface of the body, the hook head extends into or retracts from the lock hole to realize locking or unlocking of the lockset; and a handle, which comprises a connection end, wherein the handle is rotatably connected to a second end of the lock bar opposite to the first end through the connection end, and as the handle rotates around the connection end, a position of the handle changes between positions that are close to or far away from an adjacent outer surface of the body.

Optionally, a lock seat is further comprised; the lock seat is fixedly connected to the body; and the lock bar is rotatably connected to the lock seat through the connection portion.

Optionally, the lock seat is provided with a reinforcing plate, and the lock bar is rotatably connected to the reinforcing plate through the connection portion.

Optionally, a support portion is further comprised so that when the lockset is in an unlocked state, the handle is supported by the support portion.

Optionally, a limiting portion is further comprised so that when the lockset is in a locked state, the handle is fixed by the limiting portion.

Optionally, the second end of the lock bar is provided with a U-shaped groove; an opening of the U-shaped groove faces away from the box pallet; the connection end of the handle is inserted into the U-shaped groove and connected via a connecting shaft passing through two side walls of the U-shaped groove; and the handle is rotatable around the connecting shaft.

Optionally, one end of the U-shaped groove away from the handle is enclosed to increase strength.

Optionally, one side of the end portion of the connection end facing a bottom wall of the U-shaped groove is provided with a first inclined surface to prevent the connection end from interfering with the bottom wall of the U-shaped groove when the handle is rotated.

Optionally, a torsion spring is further comprised, and the torsion spring has a first force bearing end and a second force bearing end, wherein the torsion spring is sleeved on the connecting shaft; the first force bearing end abuts against a bottom wall of the U-shaped groove, and the second force bearing end abuts against the handle so that the handle abuts against the body under an elastic force of the torsion spring.

Optionally, the connection end of the handle is provided with a groove; the connecting shaft penetrates through the groove; and the torsion spring is arranged in the groove.

Optionally, the handle is provided with a limiting groove in a position corresponding to the second force bearing end of the torsion spring so as to limit the torsion spring.

Optionally, the connection end of the handle is provided with a U-shaped opening; the second end of the lock bar is inserted into the U-shaped opening and connected via a connecting shaft passing through two side walls of the U-shaped opening using a connecting shaft; and the handle is rotatable around the connecting shaft.

Optionally, a thickness of a portion of the handle away from the connection end is less than a thickness of the connection end, so that a sufficient distance is kept between the portion of the handle away from the connection end and the outer surface of the body.

Optionally, the first end of the lock bar is provided with a stop portion, and an extension direction of the stop portion is opposite to an extension direction of the hook head, wherein when the lockset is in a locked state, a tail end of the stop portion is close to or abuts against a side wall of the lock hole.

Optionally, the tail end of the stop portion is provided with a chamfer to prevent the stop portion from interfering with the side wall of the lock hole.

Optionally, when the handle is parallel to the hook head, the handle is opposite to the hook head in an extension direction.

According to another aspect of the present invention, a box pallet is provided, wherein the box pallet comprises any of the locksets as described above.

The lockset according to the present invention has a simple structure and low costs, can be processed and manufactured easily, can be operated flexibly with less effort, and can adapt to the situation of small thicknesses of an end wall and a side wall of a box pallet.

BRIEF DESCRIPTION OF THE DRAWINGS

The following drawings of the present invention are hereby incorporated as part of the present invention for the understanding of the present invention. In the drawings.

DETAILED DESCRIPTION

In the following descriptions, numerous specific details are set forth in order to provide a more thorough understanding of the present invention. However, it is obvious to the skilled in this art that the present invention may be implemented without one or more of these details. Some technical features well-known in this art are not described in other examples so as to avoid confusion with the embodiment of present invention.

The present invention discloses a lockset for box pallet, which is used for connecting an end wall and a side wall of a box pallet, and is particularly suitable for the end wall structure with a small distance between the outer surface of the end wall plate and the outer surface of the end wall stand column.

Figure 1:
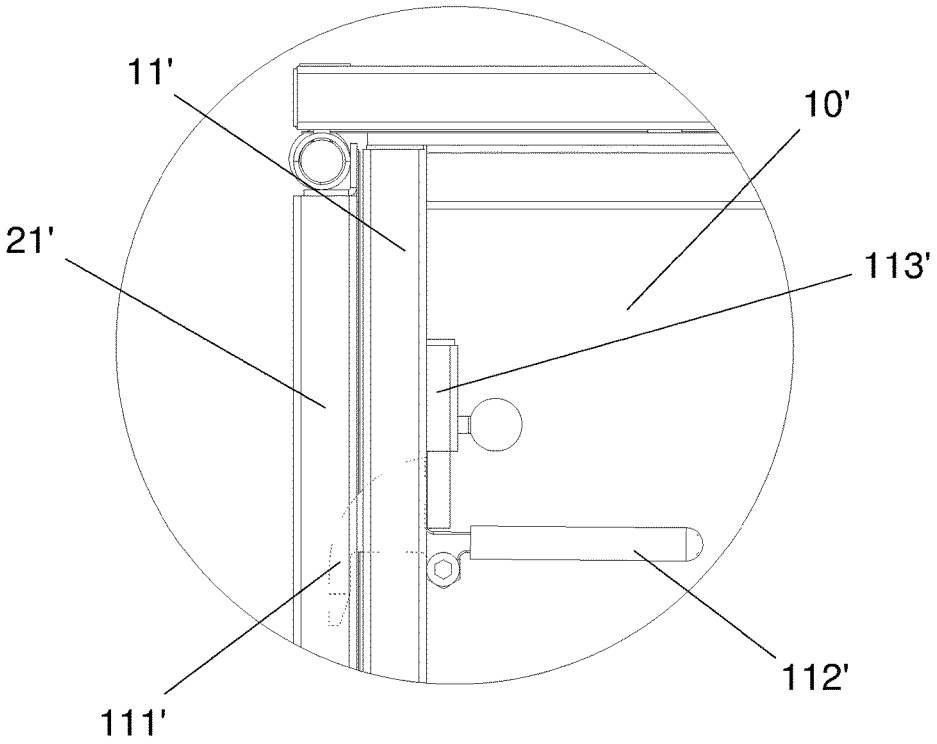
FIG. 1 is a schematic diagram of an existing box pallet lockset.
Figure 2:
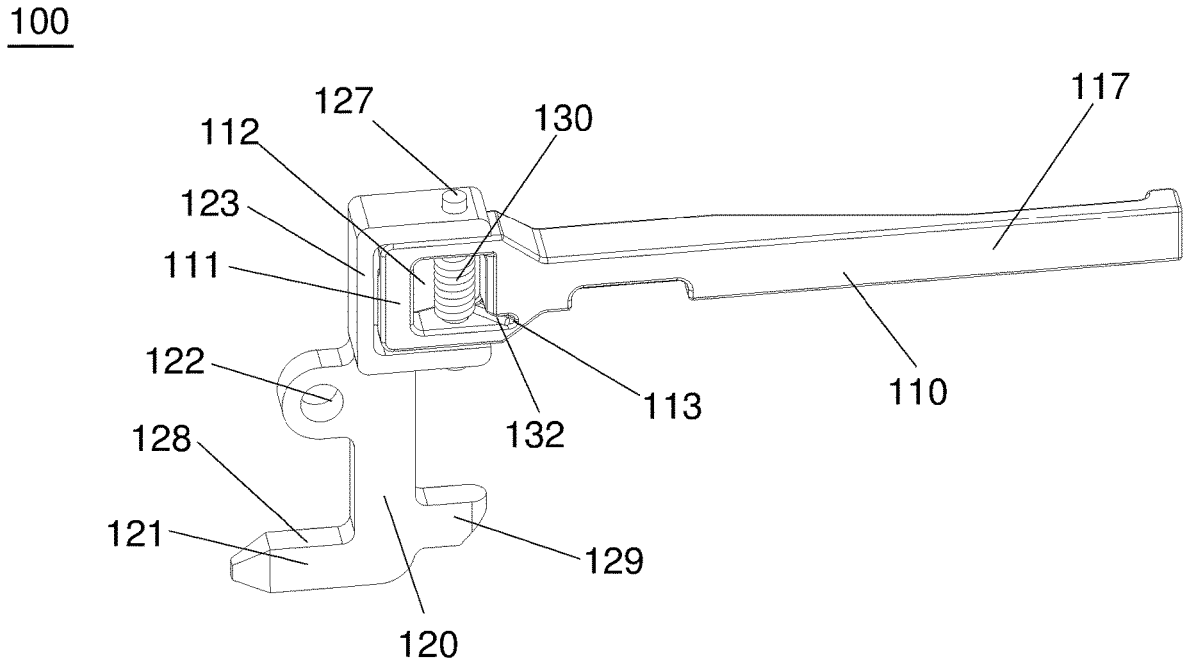
FIG. 2 is an assembly schematic diagram of a lockset according to a preferred embodiment of the present invention.
Figure 3:
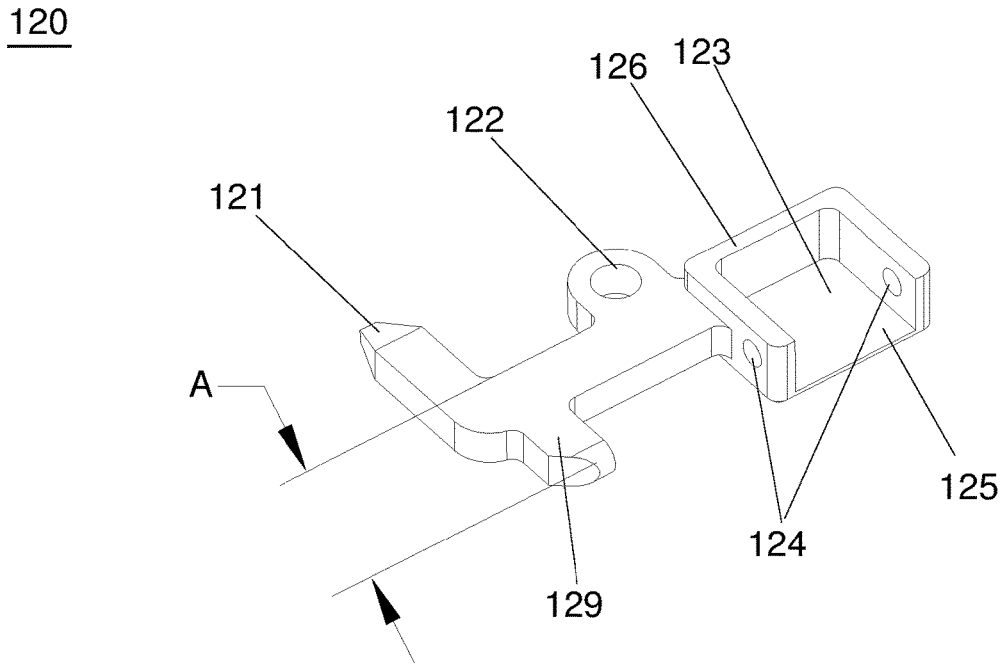
FIG. 3 is a schematic diagram of a lock bar of the lockset shown in FIG. 2.
Figure 4:
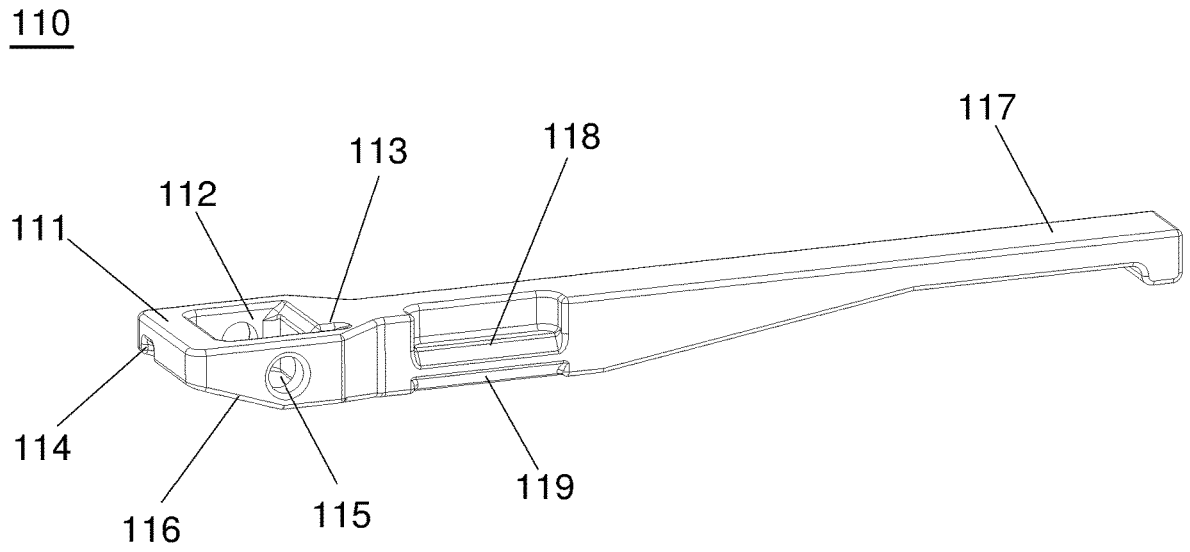
FIG. 4 is a schematic diagram of a handle of the lockset shown in FIG. 2.

As shown in FIGS. 2-4, a lockset 100 according to a preferred embodiment of the present invention is provided, and the lockset 100 mainly comprises a lock bar 120 and a handle 110.

Figure 8:
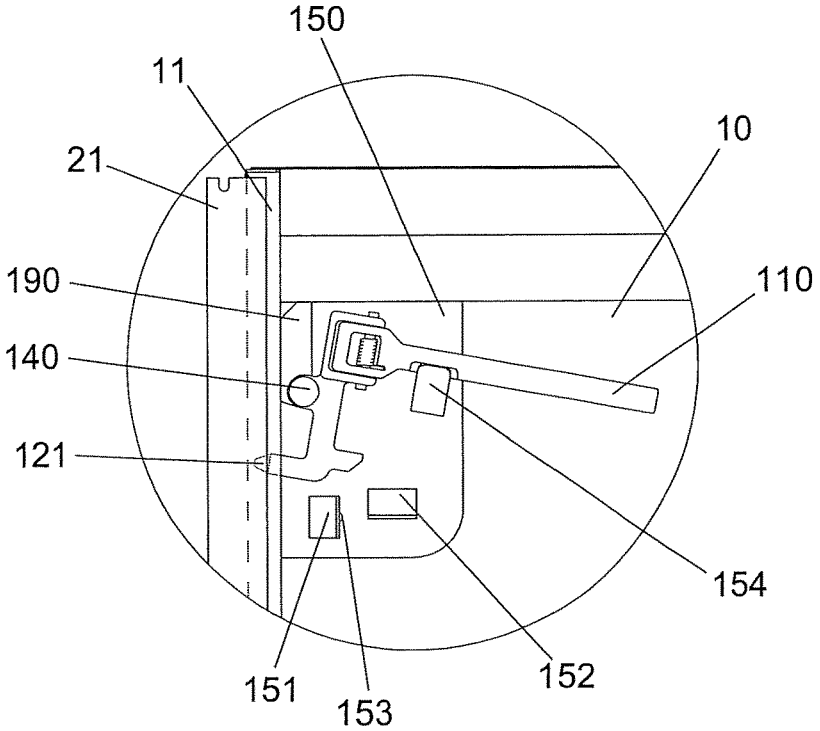
FIG. 8 is a schematic diagram showing the lockset shown in FIG. 2 being mounted to a box pallet, wherein the lockset is in an unlocked state.

One end of the lock bar 120 is provided with a hook head 121 which is perpendicular to the lock bar 120 and extends outwards from the lock bar 120; a lock hole is provided on the box pallet at a position corresponding to the mounting position of the lockset 100; and the lockset 100 realizes the locking of the box pallet through the cooperation of the hook head 121 and the lock hole. The middle of the lock bar 120 is provided with a shaft hole 122, and the plane where the shaft hole 122 is located is parallel to the plane where the lock bar 120 and the hook head 121 are located. As shown in FIG. 8, the lock bar 120 can be mounted on the outer surface of the box pallet by a positioning shaft 140, for example, passing through the shaft hole 122, so that the lock bar 120 can rotate around the positioning shaft 140, and with the rotation of the lock bar 120, the hook head 121 extends into or retracts from the lock hole. Preferably, on the premise of ensuring the connecting strength, the positioning shaft 140 can be detachably connected by a threaded connection or a pin, etc., in order to facilitate the maintenance or replacement of the lockset 100. It should be understood that the shaft hole 122 may also be directly disposed in the form of a shaft integrally formed with the lock bar 120 and perpendicular to the plane where the lock bar 120 and the hook head 121 are located. That is to say, as long as the lock bar 120 can rotate around the connection portion connected to the box pallet in a plane parallel to the outer surface of the box pallet, the present invention does not limit the specific structural form of the lock bar 120 connected to the box pallet.

A handle mounting portion 123 is provided on the second end of the lock bar 120 opposite to the hook head 121. The handle 110 is mounted to the lock bar 120 through the handle mounting portion 123, and is rotatable around the handle mounting portion 123, so that when the lockset 100 is mounted to the box pallet, with the rotation of the handle 110 around the handle mounting portion 123, the angle between the handle 110 and the outer surface of the box pallet changes within a predetermined range. Specifically, as shown in FIGS. 2 and 3, the handle mounting portion 123 is a U-shaped groove. As shown in FIG. 8, the U-shaped groove is arranged such that when the lockset 100 is mounted to the box pallet, the opening of the U-shaped groove faces away from the box pallet. Two through holes 124, which are symmetrical with each other, are respectively disposed on two side walls of the U-shaped groove, and as shown in FIG. 4, the connection end 111 of the handle 110 is also provided with mounting holes 115 at corresponding positions. When connected, the connection end 111 of the handle 110 is inserted from the opening of the U-shaped groove, and the handle 110 is connected with the lock bar 120 by cooperation of a connecting shaft 127 with the through holes 124 and the mounting holes 115. In this way, the handle 110 can rotate around the connecting shaft 127. Preferably, the connecting shaft 127 can employ a detachable form such as a threaded connection or a pin, etc., in order to facilitate the maintenance of the lockset 100 and the replacement of components. When the handle 110 is parallel to the hook head 121, the handle 110 extends in an opposite direction with that of the hook head 121, which facilitates the operation of the lockset 100. Further preferably, one end of the U-shaped groove away from the handle 110 is provided with a closed side 126, which can increase the strength of the handle mounting portion 123.

As shown in FIG. 4, the handle 110 is substantially in an elongated shape, and has a connection end 111 and an operation end 117. To facilitate operation, the thickness of the operation end 117 is smaller than that of the connection end 111, so that when the handle 110 is close to the box pallet, there is a certain operating space between the inner side surface of the operation end 117 and the outer surface of the box pallet for the fingers to stick into to lift the handle, in order to further hold the handle 110. It should be understood that the handle 110 may also be set as an arc shape having a predetermined radian along the length direction thereof, and the arc shape protrudes in a direction away from the box pallet, or the handle 110 may also adopt other structures capable of ensuring that there has sufficient operation space between the inner side of the handle 110 and the outer surface of the box pallet.

Figure 5:
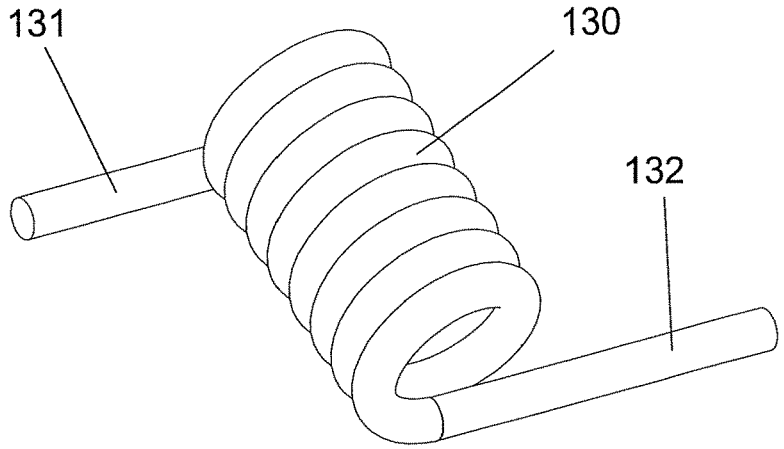
FIG. 5 is a schematic diagram of a torsion spring of the lockset shown in FIG. 2.

A groove portion 112, penetrating the handle 110 in the thickness direction thereof, is disposed at the connection end 111 of the handle 110, wherein the mounting holes 115 are located on two side walls of the groove portion 112 along the length direction of the handle 110, that is, when the handle 110 is mounted to the lock bar 120, the connecting shaft 127 passes through the groove portion 112. Preferably, a torsion spring 130 is sleeved on the connecting shaft 127 and is located in the groove portion 112. As shown in FIG. 5, the torsion spring 130 has a first force bearing end 131 and a second force bearing end 132. When installed, the first force bearing end 131 of the torsion spring 130 abuts against a surface of the bottom wall 125 of the handle mounting portion 123 which faces towards the handle 110, and the second force bearing end 132 abuts against the side of the handle 110 away from the bottom wall 125. In this way, when the lockset 100 is mounted to the box pallet, the torsion spring 130 applies a force on the handle 110 to make the handle 110 have a tendency to abut against the outer surface of the box pallet, and to prevent the handle 110 from freely rotating around the connecting shaft 127 to be protruded out of the outmost surface of the box pallet, avoiding collision or damage or accidental unlocking of the lockset by bumps in the cargo transportation process of the box pallet.

Preferably, a limiting groove 113 is provided in a position on the handle 110 where the second force bearing end 132 abuts, and the second force bearing end 132 is located in the limiting groove 113, which can keep the position of the torsion spring 130 fixed and prevent the torsion spring 130 from moving up and down along the axial direction of the connecting shaft 127. Further preferably, an escape groove 114 is provided in a side face of the handle 110 facing the bottom wall 125, and the position of escape groove 114 is corresponding to the first force bearing end 131 of the torsion spring 130, so that when the handle 110 rotates around the connecting shaft 127, the first force bearing end 131 enters the space of the escape groove 114 to prevent the connection end 111 from interfering with the first force bearing end 131 to affect the rotation of the handle 110.

Figure 6:
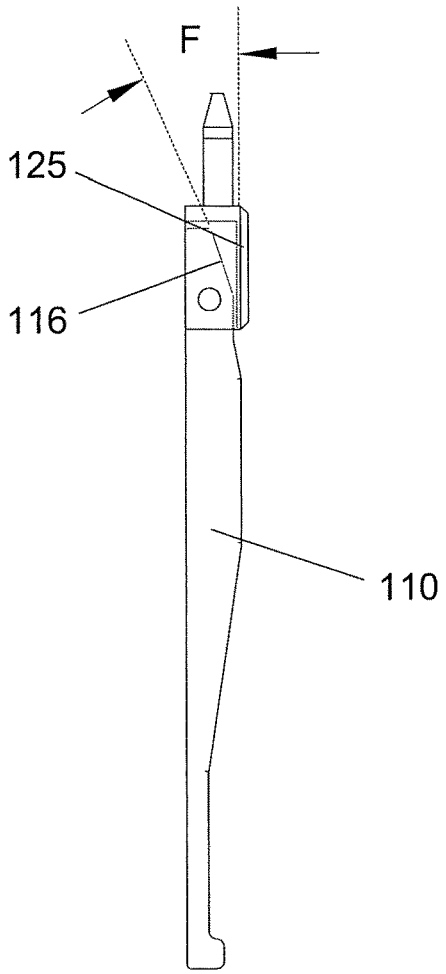
FIG. 6 is a top view of the lockset shown in FIG. 2, wherein the handle is parallel to the plane where the lock bar and the hook head are located.
Figure 7:
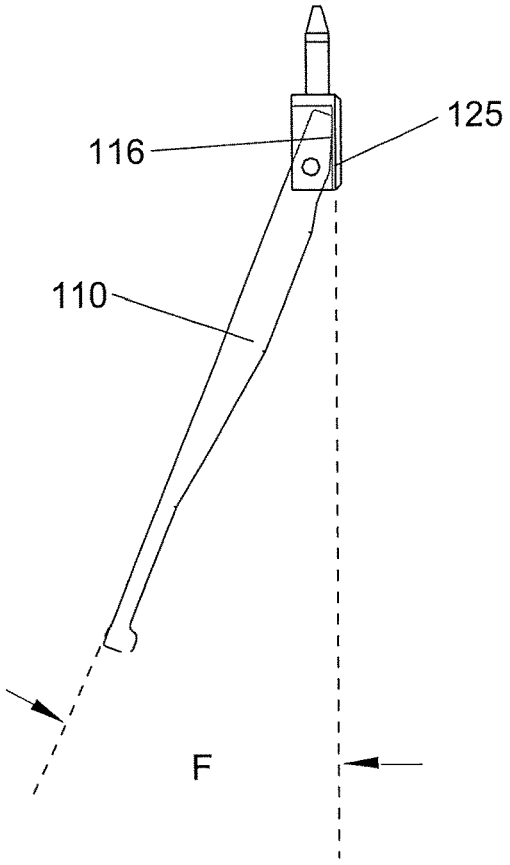
FIG. 7 is a top view of the lockset shown in FIG. 2, wherein there has a maximum included angle between the handle and the plane where the lock bar and the hook head are located.

Due to the groove portion 112, there is certainly a distance between the mounting hole 115 and the end portion of the connection end 111. In this way, under the condition that the thickness of the handle mounting portion 123 is limited, when the handle 110 is rotated, the end portion of the connection end 111 would interfere with the bottom wall 125 of the handle mounting portion 123, thereby affecting the rotation of the handle 110. Therefore, a first inclined surface 116 is provided on a side face of the end portion of the connection end 111 facing toward the bottom wall 125, and as shown in FIG. 6, an angle F is formed between the first inclined surface 116 and the bottom wall 125. Thus, the first inclined surface 116 enables the handle 110 to rotate around the connecting shaft 127 by a maximum angle of about F, as shown in FIG. 7.

Figure 9:
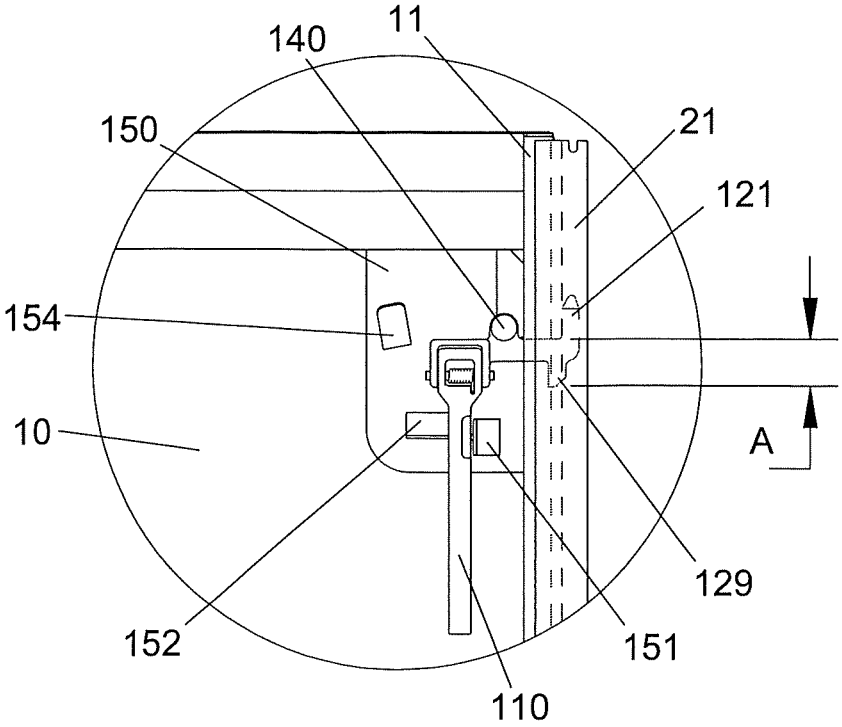
FIG. 9 is a schematic diagram showing the lockset shown in FIG. 2 being mounted to a box pallet, wherein the lockset is in a locked state.
Figure 10:
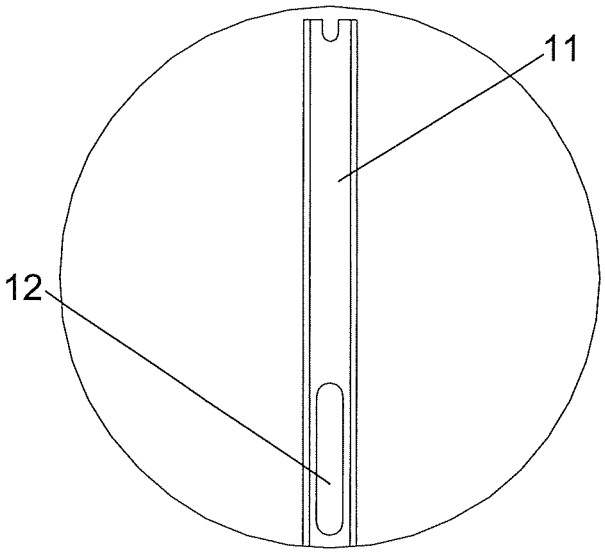
FIG. 10 is a schematic diagram of an elongated hole of an end wall stand column.
Figure 11:
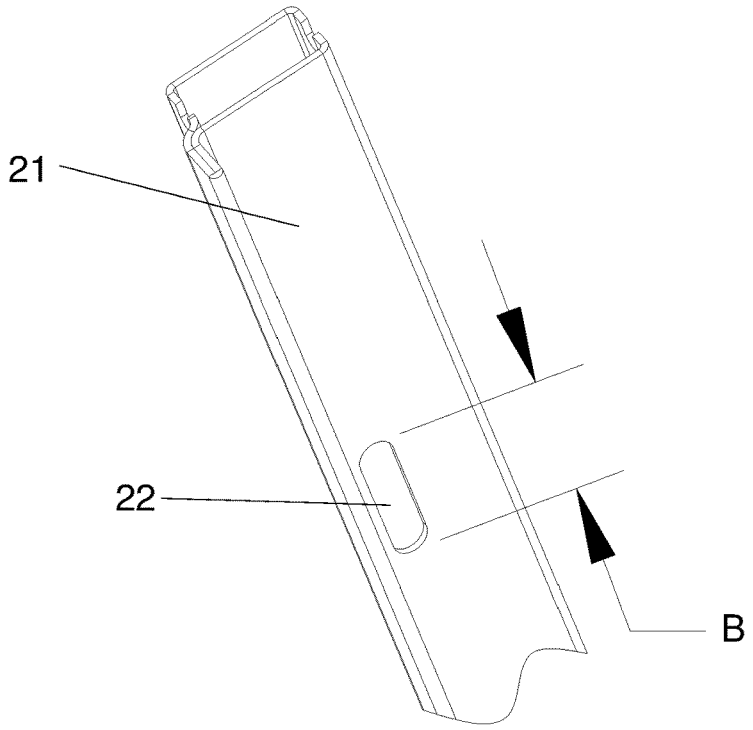
FIG. 11 is a schematic diagram of a lock hole of a side wall stand column.

As shown in FIGS. 8 to 9, the lockset 100 is mounted to the end wall panel 10 of the box pallet close to the end wall stand column 11 via a lock seat 150. A reinforcing plate 190 is further provided at the mounting position of the lockset 100 on the lock seat 150 to increase the strength. As shown in FIG. 10, an elongated hole 12, which is corresponding to the hook head 121 of the lockset 100, is provided on and penetrates through the end wall stand column 11. As shown in FIG. 11, a lock hole 22 is provided on the side wall of the side wall stand column 21 facing the end wall stand column 11 at a position corresponding to the elongated hole 12. When the lockset 100 is to be locked, the handle 110 is operated to rotate the lock bar 120 around the positioning shaft 140, and the hook head 121 moves towards the end wall stand column 11 and penetrates through the elongated hole 12 into the lock hole 22, and lock bar 120 is further rotated so that the upper surface 128 of the hook head 121 hooks the side wall of the side wall stand column 21 facing the end wall stand column 11, so as to prevent the side wall of the box pallet from moving outward in the horizontal direction, as shown in FIG. 9, thus achieving the locking of the lockset 100. Then, the handle 110 is operated to rotate around the connecting shaft 127 to abut against the outer surface of the end wall panel 10.

Preferably, a stop portion 129 is provided on one end of the lock bar 120 where the hook head 121 is provided. The stop portion 129 extents in a direction opposite to the extension direction of the hook head 121, and the length and the position of the stop portion 129 are set in advance so that when the lockset 100 is locked, the lower end of the stop portion 129 is abutted against or close to the lower side wall of the lock hole 22. Further preferably, the length of the lock hole 22 is set in advance so that the side of the lock bar 120 connected with the hook head 121 abuts against the upper side wall of the lock hole 22, that is, the distance A between the tail end of the stop portion 129 and the side of the lock bar 120 connected with the hook head 121 is equal to or slightly smaller than the length B of the lock hole 22, thereby preventing the side wall from moving up and down and making the locking firmer. Preferably, a chamfer intersecting with the lower side of the stop portion 129 is provided on the tail end of the stop portion 129, which may avoid the interference between the stop portion 129 and the lower side wall of the lock hole 22 in the locking and loosening movement process.

Preferably, a first limiting portion 151 and a second limiting portion 152 are disposed on the lock seat 150 at a position corresponding to the handle 110 when the lockset 100 is locked; the first limiting portion 151 and the second limiting portion 152 fix the handle 110 to keep the lockset 100 in a locked state, and to keep the handle 110 in a state of abutting against the end wall plate 10, so as to prevent the handle 110 from rotating around the connecting shaft 127 to be protruded out of the outer surface of the end wall plate 10 resulting in unlocking or damage caused by collision. The first limiting portion 151 and the second limiting portion 152 can be fixedly connected to the lock seat 150 in a manner such as welding, and can also be integrally formed with the lock seat 150.

Figure 12:
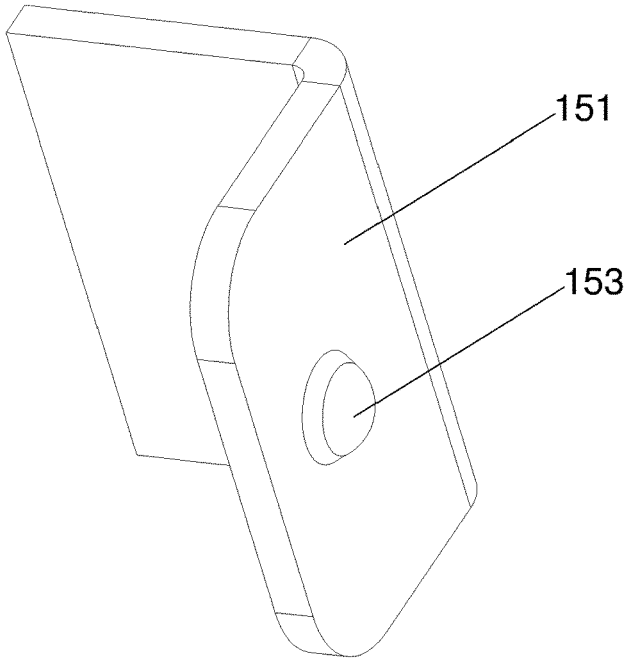
FIG. 12 is a schematic diagram of a protrusion portion.

On the side of the first limiting portion 151 facing the handle 110, a hemispherical protrusion portion 153 as shown in FIG. 12 may be provided, and the distance between the vertex of the protrusion portion 153 and the corresponding surface of the second limiting portion 152 is slightly smaller than the width of the handle 110 at the position corresponding to the protrusion portion 153. In this way, when the lockset 100 is locked, the handle 110 is restrained between the protrusion portion 153 and the outer surface of the end wall plate 10, and since the distance between the vertex of the protrusion portion 153 and the corresponding surface of the second limiting portion 152 is slightly smaller than the width of the handle 110 at the position corresponding to the protrusion portion 153, the handle 110 remains in the state of being restrained and cannot be freely separated out. Preferably, on both sides of the handle 110 at a position corresponding to the protrusion portion 153, a first guiding surface 118 and a second guiding surface 119 are provided, which specifically can be an arc-shaped surface or an inclined surface, and thus by the cooperation of the first guiding surface 118 and the second guiding surface 119 with the protrusion portion 153, it is convenient to restrain the handle and relieve restraint on the handle 110.

When the lockset 100 is in an unlocked state, the handle 110 being subjected to the force of gravity may cause the lockset 100 to have a tendency to rotate around the positioning shaft 140 toward the locked position, and thus a support portion 154 is provided on the lock seat 150 to support the handle 110 in an unlocked state, so as to prevent the lockset 100 from being automatically rotated and locked under the driving of the handle 110. The support portion 154 can be fixedly connected to the lock seat 150 in a manner such as welding, and can also be integrally formed with the lock seat 150. Preferably, the position of the support portion 154 can correspond to the positions of the first guiding surface 118 and the second guiding surface 119.

Figure 17:
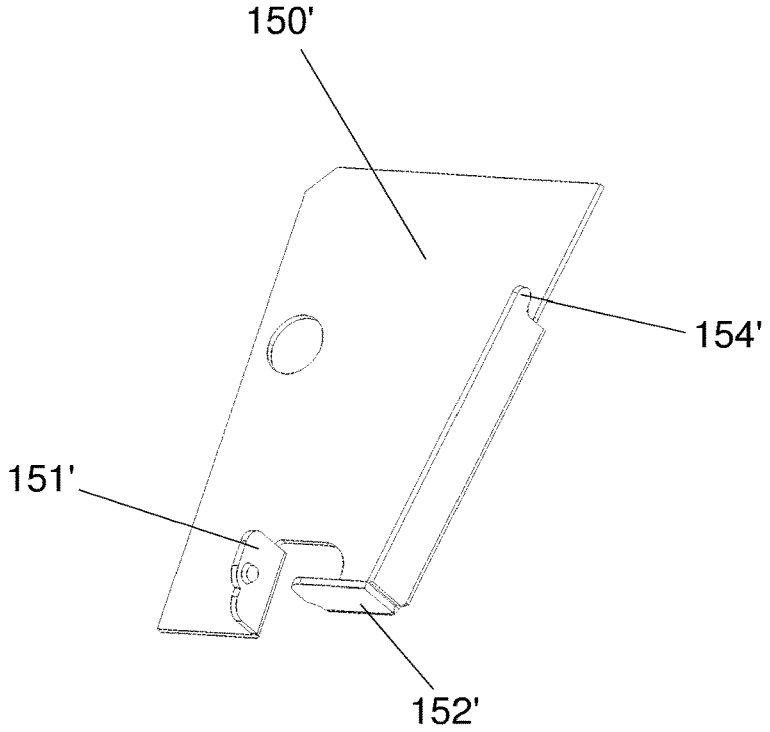
FIG. 17 is a schematic view of a preferred embodiment of a lock seat of a lockset according to the present invention, wherein the lock seat, the support portion, the first limiting portion and the second limiting portion are integrally formed.
Figure 18:
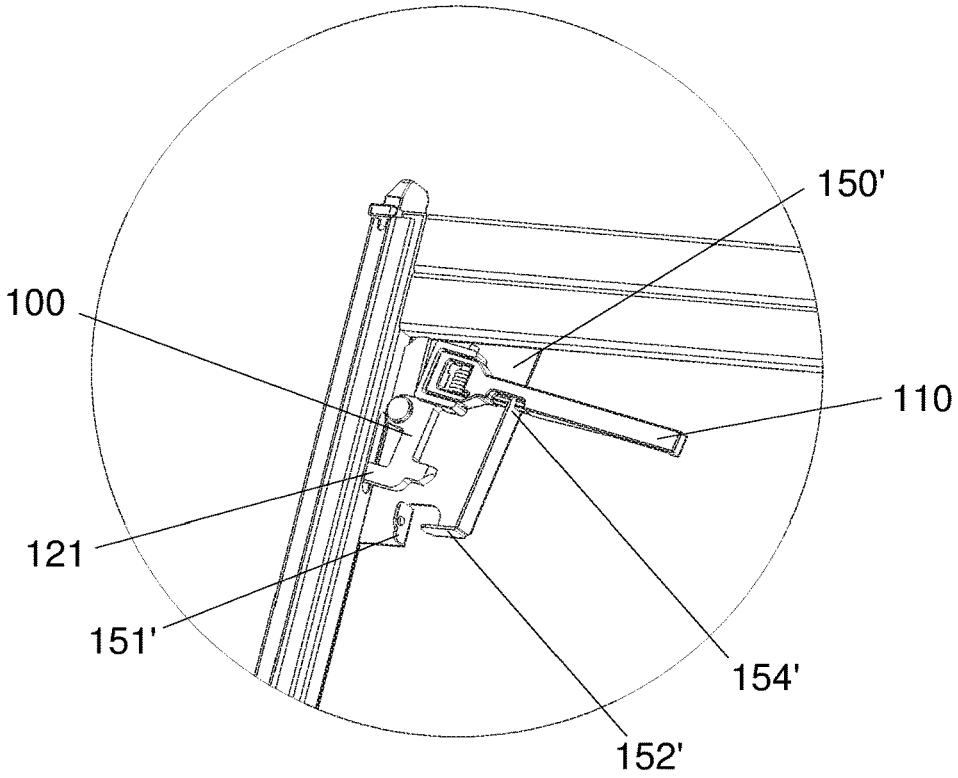
FIG. 18 is a schematic diagram showing the lock seat shown in FIG. 17 being mounted to a box pallet.

Preferably, as shown in FIGS. 17 and 18, the lock seat 150' is integrally formed with the support portion 154', the first limiting portion 151' and the second limiting portion 152', and the support portion 154' has a elongated structure, which protrudes out of the surface of the lock seat 150' and extends to the second limiting portion 152'. In the embodiment shown in FIGS. 8 and 9, during the unlocking of the lockset 100, an operator may misplace the handle 110 in a space between the second limiting portion 152 and the support portion 154, so that the lockset 100 is in an incomplete unlocking state, and the hook head 121 cannot be completely retracted into the inner space of the end wall stand column 11, and at this time, if the box pallet is folded, the most front end of the hook head 121 may scratch the side wall, and the folding of the box pallet cannot be completed. According to this embodiment, the handle 110 needs to be lifted by an operator to the support portion 154', and only in this way, it could be placed close to the outer surface of the box pallet; otherwise, the handle 110 may be in a supporting state away from the outer surface of the box pallet due to the support portion 154', which can serve as a warning and reminder. In this way, the incomplete unlocking state of the lockset 100 can be avoided. According to the embodiment, the lock seat is integrally formed with the support portion, the first limiting portion and the second limiting portion, and such a structure is simple in manufacturing, low in cost, good in strength, and beautiful in appearance, and is a preferred embodiment.

It should be pointed out that the purpose of providing the lock seat and the reinforcing plate is to increase the strength of the box pallet, and prevent the body of the box pallet from being damaged due to excessive force on the lockset when the lockset is locked. On the premise of ensuring the strength, the lockset may be mounted directly to the outer surface of the box pallet without providing a reinforcing plate or even without a lock seat. At this time, the limiting portion and the support portion can be directly connected to the outer surface of the box pallet.

According to the lockset 100 shown in the present invention, the locking process is as below:

As shown in FIG. 8, the lockset 100 is in an unlocking state. When locking is required, the operator sticks his/her fingers into the inner side of the handle 110, and pushes the handle 110 upwards, so that the lockset 100 rotates around the positioning shaft 140 and the handle extends beyond the top edge of the support portion 154, and then lifts the handle 110 toward the outside of the box so that the handle 110 can overcome the force of the second force bearing end 132 of the torsion spring 130 applied on the handle 110, and rotate around the connecting shaft 127 to a maximum angle F (at the moment, the intersection ridge between the most front end surface of the connection end 111 of the handle 110 and the first inclined surface 116 is in contact with the bottom wall 125 of the U-shaped groove of the handle mounting portion 123, as shown in FIG. 7). The handle 110 is then held down to rotate the lock bar 120 around the positioning shaft 140; the hook head 121 penetrates through the elongated hole 12 in the end wall stand column 11 firstly, and then penetrates through a lock hole 22 in the side wall of the side wall stand column 21 towards the end wall stand column 11; the upper surface 128 of the hook head 121 hooks the inner side of the side wall of the lock hole 22; the lower end of the stop portion 129 is abutted against or close to the lower side wall of the lock hole 22; and the side of the lock bar 120 connected with the hook head 121 abuts against the upper side wall of the lock hole 22 (such that the locking force point of the hook head 121 is as close as possible to the axial center plane of the positioning shaft 140, which may reduce the torque generated by the locking force of the hook head 121 on the positioning shaft 140, thereby reducing the pressure on the handle 110 in a locked state exerted by the second limiting portion 152 since the handle 110 has to resist the torque, and improving the locking force of the lockset).

After the lock bar 120 is locked, the handle 110 faces an area between the first limiting portion 151 and the second limiting portion 152. The handle 110 is pushed in the direction towards the end wall plate 10. Firstly, the second guiding surface 119 of the handle 110 is in contact with the protrusion portion 153, and meanwhile another side of the handle 110 is in contact with the vertical edge of the second limiting portion 152; the handle 110 is pushed by force so that the protrusion portion 153 crosses the second guiding surface 119 and is located outside the first guiding surface 118 to block the first guiding surface 118 and fix the handle 110. At this time, the inner side of the handle 110 is attached to the end wall plate 10; the protrusion portion 153 ensures that the handle 110 cannot freely rotate outside the box; the torsion spring 130 further enables the handle 110 to be tightly attached to the end wall plate 10 to prevent the handle 110 from rotating out of the box and prevent the handle 110 from protruding out of the body; the first limiting portion 151 and the second limiting portion 152 can also ensure that the handle 110 cannot swing left and right. This completes the locking of the end wall and side wall of the box pallet by the lockset 100.

The unlocking process of the lockset 100 shown in the present invention is as below:

As shown in FIG. 9, the lockset 100 is in a locked state. An operator lifts the handle 110 by his/her fingers, and a gap is preferably reserved between the first guiding surface 118 and the protrusion portion 153, so that the fingers can stick into the space between the handle 110 and the end wall plate 10 to facilitate the application of force, and only the force of the torsion spring 130 needs to be overcome during this period. The handle 110 continues to be lifted toward the outside of the box. At this time, the first guiding surface 118 is in contact with the protrusion portion 153, and the force of the torsion spring 130 and the resistance of the protrusion portion 153 should be overcome at the same time; the handle is lifted to a maximum angle F to be separated from the protrusion portion 153 and the second limiting portion 152. The handle 110 is then held to rotate upward; the lock bar 120 rotates around the positioning shaft 140; the most front section of the hook head 121 separates from the side wall stand column 21 and retracts into the inner space of the end wall stand column 11; and at the moment, the end wall completely separates from the side wall. The handle 110 is then hung on the support portion 154 for fixation to ensure that the handle 110 would not rotate downward around the positioning shaft 140 due to gravity, which otherwise would cause the lock bar 120 protrude out of the end wall stand column 11 and further affect the folding and assembly of the end wall, or lock the end and side walls again. In this way, the lockset completes unlocking. After unlocking, the box pallet can be folded or disassembled.

Figure 13:
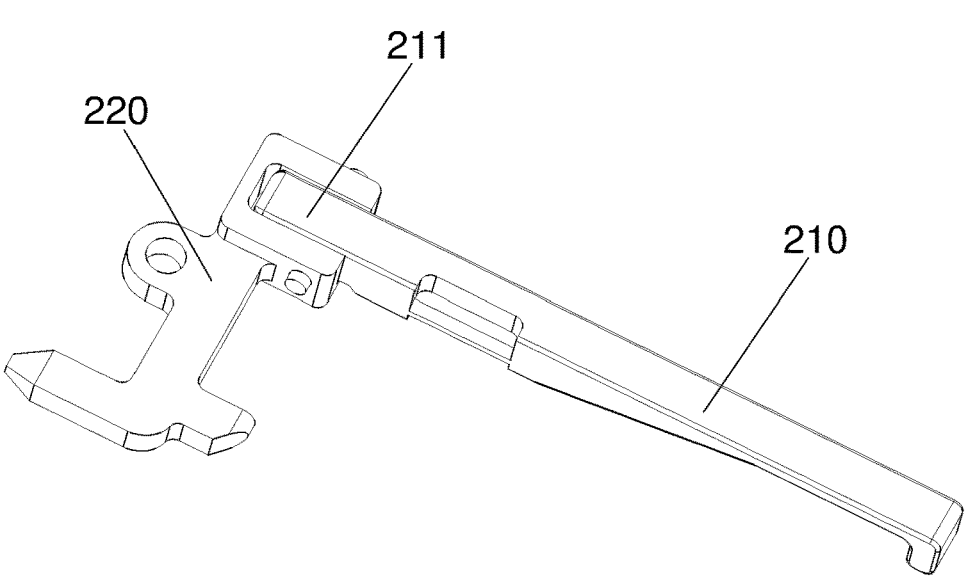
FIG. 13 is a schematic diagram of a lockset according to a second embodiment of the present invention.
Figure 14:
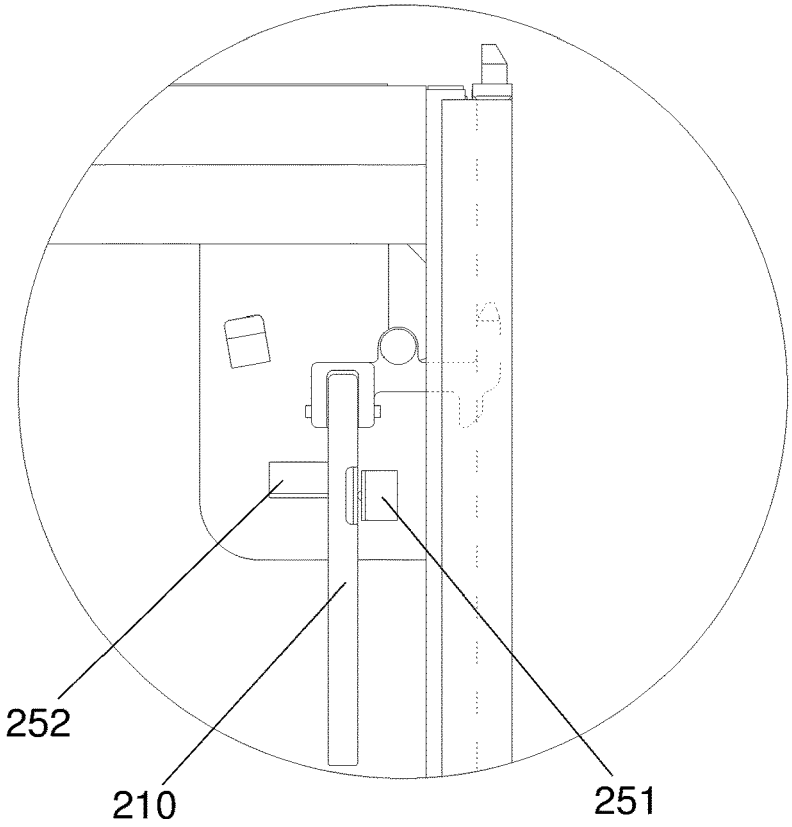
FIG. 14 is a schematic diagram showing the lockset shown in FIG. 13 being mounted to a box pallet, wherein the lockset is in a locked state.

As shown in FIGS. 13 and 14, a lockset 200 according to a second embodiment of the present invention is provided.

The structure of the lockset 200 is substantially same as that of the lockset 100, except that the connection end 211 of the handle 210 is not provided with a groove portion as that of the handle 110, and no torsion spring is mounted. The handle 210 does not need to overcome the acting force of the torsion spring during the lifting process; when the lockset 200 is in a locked state, there is no action force on the handle 210 given by the torsion spring, and the handle 210 is only restrained by cooperation of the first limiting portion 251 and the second limiting portion 252 from rotating toward outside of the box so as to achieve the effect of limiting and fixing.

The lockset 200 according to the second embodiment has the same operation mode as the lockset 100 according to the first embodiment, which is not repeated here.

Figure 15:
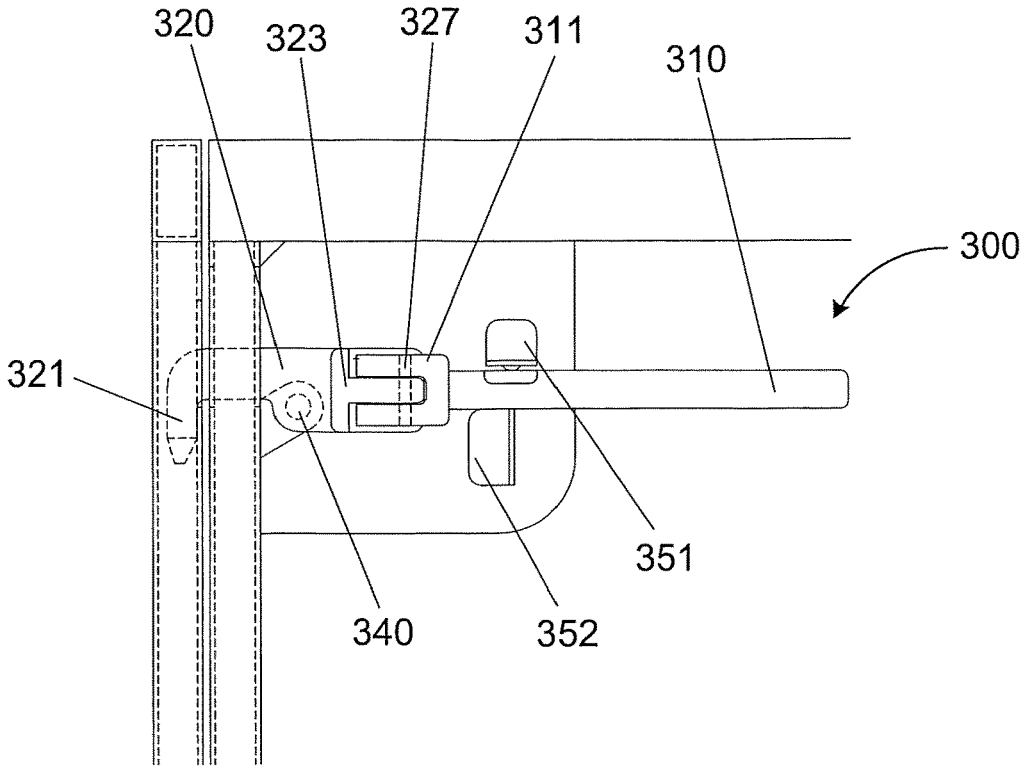
FIG. 15 is a schematic diagram showing the lockset according to a third embodiment of the present invention being mounted to a box pallet, wherein the lockset is in a locked state.
Figure 16:
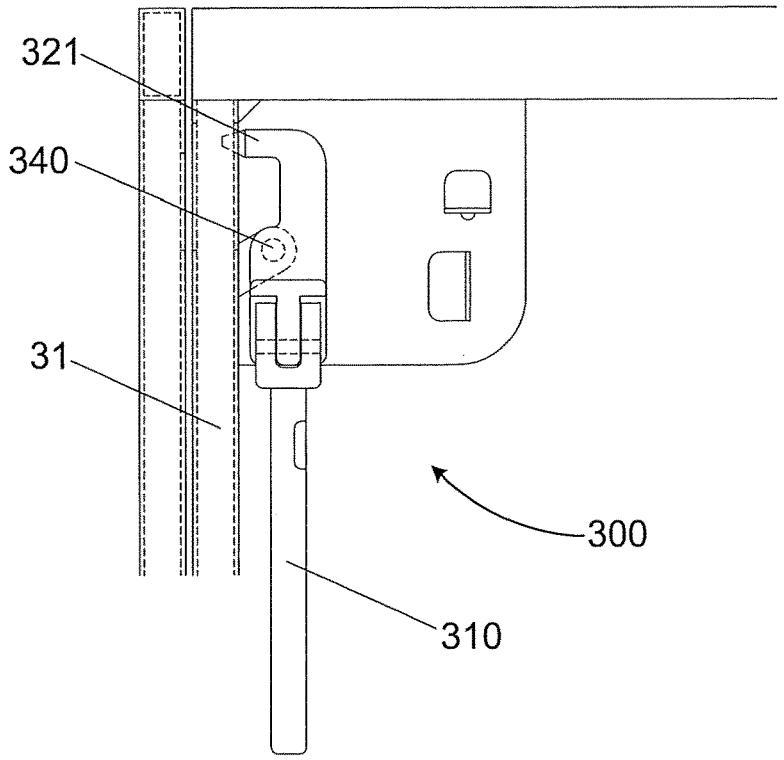
FIG. 16 is a schematic diagram of an unlocked state of the lockset shown in FIG. 15 mounted to a box pallet.

As shown in FIGS. 15 and 16, a lockset 300 according to a third embodiment of the present invention is provided.

The lockset 300 differs from the lockset 100 and the lockset 200 in that the handle mounting portion 323 of the lock bar 320 is T-shaped; the vertical wall of the T-shape corresponds to the two side walls of the U-shaped groove; the connection end 311 of the handle 310 is provided with a U-shaped opening; the vertical wall of the T-shape is inserted into the U-shaped opening of the handle 310 and they are connected together by the connecting shaft 327.

When the lockset 300 is in a locked state, the hook head 321 is downward; the hook head 321 is perpendicular to the handle 310; and the handle 310 is fixed by the first limiting portion 351 and the second limiting portion 352. When the lockset 300 is to be unlocked, the handle 310 is first lifted by about angle F to disengage from the constraints of the first limiting portion 351 and the second limiting portion 352; the handle 310 is rotated downward, and the lock bar 320 rotates around the positioning shaft 340 until the hook head 321 retracts into the end wall stand column 31; at this time, the handle 310 naturally droops under its own gravity, and is substantially parallel to the end wall stand column 31.

The lockset according to the third embodiment is simple in structure; the support portion is omitted, and the operation is labor-saving. However, when the lockset is in a locked state, the reliability of fixing of the handle is not as good as that in the first and second embodiments. In the same case where the torsion spring is not provided, the reliability of fixing of the handle is not as good as that in the second embodiment. When the lockset is in an unlocked state, the handle is not restrained by other force except for its own gravity, so that the handle would swing around due to the external force, and its stability is not as good as that in the first and second embodiments; the hook head may rotate around the positioning shaft due to the external force, so that the hook head extends out of the end wall stand column and blocks the assembly or folding of the end wall.

According to another aspect of the present invention, a box pallet is provided, and the box pallet comprises any of the locksets described above.

The box pallet lockset according to the present invention has a simple structure and low costs, can be processed and manufactured easily, can be operated flexibly with less effort, and can adapt to the situation of small thicknesses of an end wall and a side wall of a box pallet.

The present invention has been described by way of the above embodiments, but it is to be understood that the above-described embodiments are for illustrative and explanatory purposes only and are not intended to limit the invention to the scope of the described embodiments. In addition, it will be understood by those skilled in the art that various modifications and variations can be made in accordance with the teachings of the present invention, which fall within the scope of the invention as claimed. The protection scope of the present invention is defined by the appended claims and its equivalent scope.

What is claimed is:

1. A lockset for a box pallet, the box pallet having a lock hole corresponding to the lockset, the lockset comprising:

a lock bar, a first end of which being provided with a hook head matched with the lock hole to realize locking, the lock bar being provided with a connection portion, wherein the lock bar is rotatably connectable to a body of the box pallet through the connection portion, and as the lock bar rotates around the connection portion in a plane parallel to an outer surface of the body, the hook head extends into or retracts from the lock hole to realize locking or unlocking of the lockset; and a handle comprising a connection end, wherein the handle is rotatably connected to a second end of the lock bar opposite to the first end through the connection end, and as the handle rotates around the connection end, a position of the handle changes between a first position where the handle abuts against an adjacent outer surface of the body and a second position where the handle is spaced form the adjacent outer surface of the body.

2. The lockset according to claim 1, further comprising a lock seat fixedly connectable to the body, and the lock bar being rotatably connected to the lock seat through the connection portion.

3. The lockset according to claim 2, wherein the lock seat is provided with a reinforcing plate, and the lock bar is rotatably connected to the reinforcing plate through the connection portion.

4. The lockset according to claim 1, further comprising a support portion, wherein the handle is supported by the support portion when the lockset is in an unlocked state.

5. The lockset according to claim 1, further comprising a limiting portion wherein the handle is fixed by the limiting portion when the lockset is in a locked state.

6. The lockset according to claim 1, wherein the second end of the lock bar is provided with a U-shaped groove; an opening of the U-shaped groove faces away from the box pallet; the connection end of the handle is inserted into the U-shaped groove and connected via a connecting shaft passing through two side walls of the U-shaped groove; and the handle is rotatable around the connecting shaft.

7. The lockset according to claim 6, wherein one end of the U-shaped groove away from the handle is enclosed to increase strength.

8. The lockset according to claim 7, wherein one side of the end portion of the connection end facing a bottom wall of the U-shaped groove is provided with a first inclined surface to prevent the connection end from interfering with the bottom wall of the U-shaped groove when the handle is rotated.

9. The lockset according to claim 6, further comprising a torsion spring having a first force bearing end and a second force bearing end, wherein the torsion spring is sleeved on the connecting shaft; the first force bearing end abuts against a bottom wall of the U-shaped groove, and the second force bearing end abuts against the handle so that the handle abuts against the body under an elastic force of the torsion spring.

10. The lockset according to claim 9, wherein the connection end of the handle is provided with a groove; the connecting shaft penetrates through the groove; and the torsion spring is arranged in the groove.

11. The lockset according to claim 9, wherein the handle is provided with a limiting groove in a position corresponding to the second force bearing end of the torsion spring so as to limit the torsion spring.

12. The lockset according to claim 1, wherein the connection end of the handle is provided with a U-shaped opening; the second end of the lock bar is inserted into the U-shaped opening and connected via a connecting shaft passing through two side walls of the U-shaped opening; and the handle is rotatable around the connecting shaft.

13. The lockset according to claim 1, wherein a thickness of a portion of the handle away from the connection end is less than a thickness of the connection end, so that a sufficient distance is kept between the portion of the handle away from the connection end and the outer surface of the body.

14. The lockset according to claim 1, wherein the first end of the lock bar is provided with a stop portion, and an extension direction of the stop portion is opposite to an extension direction of the hook head, wherein when the lockset is in a locked state, a tail end of the stop portion abuts against a side wall of the lock hole.

15. The lockset according to claim 14, wherein the tail end of the stop portion is provided with a chamfer to prevent the stop portion from interfering with the side wall of the lock hole.

16. The lockset according to claim 1, wherein when the handle is parallel to the hook head, the handle is opposite to the hook head in an extension direction.

17. A box pallet, wherein the box pallet comprises a lockset according claim 1, and the lock bar is rotatably connected to the body of the box pallet through the connection portion.

* * * * *